US008505164B2

(12) United States Patent
Katou

(10) Patent No.: US 8,505,164 B2
(45) Date of Patent: Aug. 13, 2013

(54) VEHICLE DOOR HINGE

(75) Inventor: Kenji Katou, Kariya (JP)

(73) Assignee: Toyota Shatai Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/395,105

(22) PCT Filed: Sep. 10, 2009

(86) PCT No.: PCT/JP2009/065795
§ 371 (c)(1),
(2), (4) Date: May 7, 2012

(87) PCT Pub. No.: WO2011/030417
PCT Pub. Date: Mar. 17, 2011

(65) Prior Publication Data

US 2012/0227215 A1 Sep. 13, 2012

(51) Int. Cl.
*E05D 11/00* (2006.01)
*E05D 5/00* (2006.01)
*C23F 17/00* (2006.01)

(52) U.S. Cl.
USPC ..... 16/273; 16/386; 204/484

(58) Field of Classification Search
USPC ..... 16/273, 386, 387; 427/258; 296/146.11, 296/39.1; 29/458, 459, 460; 205/170, 122, 205/135; 204/486, 485, 484, 487, 488, 499
See application file for complete search history.

(56) References Cited

U.S. PATENT DOCUMENTS

| | | | | | |
|---|---|---|---|---|---|
| 2,551,695 | A | * | 5/1951 | Oddy | 305/104 |
| 3,988,231 | A | * | 10/1976 | Kato et al. | 204/486 |
| 4,036,721 | A | * | 7/1977 | Kato et al. | 204/486 |
| 4,675,940 | A | * | 6/1987 | Brockhaus | 16/273 |
| 4,756,975 | A | * | 7/1988 | Fujii et al. | 428/461 |
| 5,092,017 | A | * | 3/1992 | Hatano et al. | 16/277 |
| 5,129,253 | A | * | 7/1992 | Austin et al. | 72/370.07 |
| 5,376,457 | A | * | 12/1994 | Smith | 428/457 |
| 5,577,295 | A | * | 11/1996 | Papke et al. | 16/254 |
| 5,682,646 | A | * | 11/1997 | Tyler et al. | 16/386 |

(Continued)

FOREIGN PATENT DOCUMENTS

| | | | | |
|---|---|---|---|---|
| DE | 3416960 | A1 | * | 11/1985 |
| DE | 19960736 | C1 | * | 7/2001 |

(Continued)

*Primary Examiner* — Victor Batson
*Assistant Examiner* — Jason W San
(74) *Attorney, Agent, or Firm* — Douglas J. Christensen

(57) ABSTRACT

A vehicle door hinge that is positioned between a vehicle main body and a vehicle door and connects the same to each other in order to connect the vehicle door to the vehicle main body so as to be openable and closable may include a female bracket that is securely attached to one of the vehicle main body and the vehicle door, a male bracket that is securely attached to the other of the vehicle main body and the vehicle door, a rotation shaft member that is secured to the female bracket and supports the male bracket to be rotatable relative to the female bracket. A coating film capable of restricting an electric current from flowing from the rotation shaft member to each of the slide bushes is formed in a portion of an outer circumferential surface of the rotation shaft member, which portion includes a part of a contact portion thereof that slidably contacts each of the slide bushes in a rotational axis direction and at least a proximity range thereof that is positioned in proximity to an exposed end periphery of each of the slide bushes.

2 Claims, 8 Drawing Sheets

(56) References Cited

U.S. PATENT DOCUMENTS

| | | | | |
|---|---|---|---|---|
| 5,950,295 | A * | 9/1999 | Worden et al. | 29/423 |
| 6,159,602 | A * | 12/2000 | Kadokura et al. | 428/403 |
| 6,162,339 | A * | 12/2000 | Salman et al. | 204/484 |
| 6,163,929 | A * | 12/2000 | Bradley | 16/380 |
| 6,178,599 | B1 * | 1/2001 | Worden et al. | 16/386 |
| 6,258,241 | B1 * | 7/2001 | Takahashi | 205/159 |
| 6,427,287 | B1 * | 8/2002 | Brueckner et al. | 16/342 |
| 6,485,627 | B1 * | 11/2002 | Johal et al. | 205/148 |
| 7,059,032 | B2 * | 6/2006 | Lehner | 29/402.08 |
| 7,677,639 | B2 * | 3/2010 | Cafeo et al. | 296/146.11 |
| 7,833,401 | B2 * | 11/2010 | Han et al. | 205/170 |
| 7,854,967 | B2 * | 12/2010 | Keener et al. | 427/407.1 |
| D649,006 | S * | 11/2011 | Johnson et al. | D8/323 |
| 8,066,863 | B2 * | 11/2011 | Han et al. | 205/170 |
| 8,231,926 | B2 * | 7/2012 | Nesbitt | 427/2.1 |
| 2003/0182761 | A1 * | 10/2003 | Kidd | 16/386 |
| 2003/0201182 | A1 * | 10/2003 | Nakamura et al. | 204/484 |
| 2004/0016643 | A1 * | 1/2004 | Emmonds et al. | 204/509 |
| 2005/0161330 | A1 * | 7/2005 | Toi et al. | 204/484 |
| 2007/0000783 | A1 * | 1/2007 | Kawanami et al. | 204/478 |
| 2007/0114131 | A1 * | 5/2007 | Anderson et al. | 204/471 |
| 2008/0295290 | A1 * | 12/2008 | Murray et al. | 16/386 |
| 2009/0211909 | A1 * | 8/2009 | Nesbitt | 204/487 |
| 2009/0250346 | A1 * | 10/2009 | Weschke et al. | 204/471 |
| 2010/0224500 | A1 * | 9/2010 | Takahashi et al. | 205/170 |
| 2010/0266793 | A1 * | 10/2010 | Hsu et al. | 428/35.7 |
| 2011/0035906 | A1 * | 2/2011 | Esaki et al. | 16/374 |
| 2011/0041944 | A1 * | 2/2011 | Duquette et al. | 138/140 |
| 2011/0049834 | A1 * | 3/2011 | Natu | 280/279 |
| 2011/0289727 | A1 * | 12/2011 | Le | 16/273 |
| 2012/0227215 | A1 * | 9/2012 | Katou | 16/273 |
| 2013/0004761 | A1 * | 1/2013 | Worsley et al. | 428/310.5 |
| 2013/0036930 | A1 * | 2/2013 | Sullivan et al. | 102/202.7 |

FOREIGN PATENT DOCUMENTS

| | | | |
|---|---|---|---|
| JP | 58-193395 | | 11/1983 |
| JP | 58193395 | A * | 11/1983 |
| JP | 60-110898 | | 6/1985 |
| JP | 60110898 | A * | 6/1985 |
| JP | 3-54476 | | 5/1991 |

* cited by examiner

Graph Illustrating Relation Between Electrically Conductive Range and Electrical Resistance

VEHICLE DOOR HINGE

PRIORITY CLAIM

The present application is a National Phase entry of PCT Application No. PCT/JP2009/065795, filed Sep. 10, 2009, the disclosure of which is hereby incorporated by reference herein in its entirety.

TECHNICAL FIELD

The present invention relates to a vehicle door hinge that is positioned between a vehicle main body and a vehicle door and connects the same to each other in order to connect the vehicle door to the vehicle main body so as to be openable and closable.

BACKGROUND ART

Conventionally, an automotive vehicle door is connected to a vehicle main body so as to be openable and closable. That is, provided between the vehicle main body and the vehicle door is a vehicle door hinge connecting the same to each other. Thus, the vehicle door is rotatably connected to the vehicle main body so as to be openable and closable. This vehicle door hinge generally has a female bracket securely provided to the vehicle main body, a male bracket securely provided to the vehicle door, and a rotation shaft member that is configured to rotatably connect the male bracket to the female bracket so as to be relatively rotated to each other. Further, provided between the rotation shaft member and the male bracket is a slide bush. This slide bush is configured to rotate integrally with the male bracket, so as to smoothly rotate the male bracket with respect to the rotation shaft member that is integrally connected to the female bracket.

In a coating line of a manufacturing process, the vehicle main body is applied with electrodeposition coating as a rust prevention measure in a condition in which the vehicle door is connected to the vehicle main body via the above-described vehicle door hinge. An example of this electrodeposition (ED) coating is a cation coating. In particular, the vehicle main body with the vehicle door connected thereto is dipped in a coating liquid in which water-based paint is dissolved. Thereafter, electrodes are respectively connected to the vehicle main body thus dipped and the coating liquid, and voltage is applied between these electrodes. Thus, an electric current flows through the vehicle main body and the vehicle door connected thereto via the vehicle door hinge, so that the coating liquid thereon can be electrodeposited thereon. As a result, an ED coating film having rust prevention performance can be formed on a surface of the vehicle main body including the vehicle door (for example, Japanese Laid-Open Patent Publication No. 60-110898).

Further, the electric current flows from the electrode connected to the vehicle main body to the vehicle door via the vehicle door hinge. The electric current flowing through this vehicle door hinge flows in the order of the female bracket, the rotation shaft member, the slide bush and the male bracket. These members are formed of electroconductive materials and are positioned in contact with each other. Therefore, the electric current can flow from the vehicle main body to the vehicle door via the vehicle door hinge.

On the other hand, in the above-described ED coating, the electric current can flow through the vehicle door hinge, so that the ED coating film can be formed on the vehicle door hinge. This ED coating film is also formed over a boundary portion between the rotation shaft member and the slide bush.

Thus, when the slide bush is rotated relative to the rotation shaft member, the ED coating film formed over the boundary portion between the rotation shaft member and the slide bush can be cracked and peeled off. The ED coating film thus cracked and peeled off can be scattered at the time of subsequent spray coating, and can be included in a spray coating film. If the cracked or peeled coating film remains during spray coating film, a roughened surface called a so-called "coating irregularity" is generated on a surface of the spray coating film. This may lead to deterioration of product quality.

As a countermeasure against the generation of such an "uneven coating," a method is conventionally known. In the method, an ED coating film is previously formed on only the rotation shaft member of the vehicle door hinge before the ED coating is applied to the entire vehicle main body. When the ED coating film is previously formed on only the rotation shaft member, electrical conductivity with respect to external contact can be reduced by the ED coating film. Thus, when the ED coating is performed on the entire vehicle main body after the ED coating film is formed, the coating liquid can be prevented from being electrodeposited by the previously formed ED coating film. As a result, the ED coating film can be prevented from being newly formed over the boundary portion between the rotation shaft member and the slide bush.

However, the previously formed ED coating film may lead to a reduction in conductive property due to the external contact. As a result, electricity supply performance for the female bracket and the slide bush contacting this rotation shaft member can be impaired. Thus, a stable electric current equivalent to the current fed to the vehicle main body cannot be fed to the vehicle door. As a result, the ED coating film can be non-uniformly formed on the vehicle door. This may lead to deterioration of the product quality.

Thus, there is a need in the art to provide an improved vehicle door hinge.

SUMMARY OF THE INVENTION

A first aspect of the present invention provides a vehicle door hinge that is positioned between a vehicle main body and a vehicle door and connects the same to each other in order to connect the vehicle door to the vehicle main body so as to be openable and closable, which may include a female bracket that is securely attached to one of the vehicle main body and the vehicle door, a male bracket that is securely attached to the other of the vehicle main body and the vehicle door, a rotation shaft member that is secured to the female bracket and supports the male bracket to be rotatable relative to the female bracket, wherein slide bushes are disposed between the rotation shaft member and the male bracket in order to smoothly rotate the male bracket with respect to the rotation shaft member, the slide bushes being capable of rotating integrally with the male bracket, wherein the female bracket, the male bracket, the rotation shaft member and the slide bushes are made of an electroconductive material, so as to be electrically connected to each other when these members contact each other, and wherein a coating film capable of restricting an electric current from flowing from the rotation shaft member to each of the slide bushes is formed in a portion of an outer circumferential surface of the rotation shaft member, which portion includes a part of a contact portion thereof that slidably contacts each of the slide bushes in a rotational axis direction and at least a proximity range thereof that is positioned in proximity to an exposed end periphery of each of the slide bushes.

Further, "at least a proximity range thereof that is positioned in proximity to an exposed end periphery of each of the slide bushes" corresponds to a proximity range which extends over approximately "0.5 to 2.0 mm" from the exposed end periphery of each of the slide bushes in the rotational axis direction. Further, "a coating film capable of restricting an electric current from flowing from the rotation shaft member to each of the slide bushes" is formed in a portion of the outer circumferential surface of the rotation shaft member, which portion includes at least the proximity range thereof that is positioned in proximity to the exposed end periphery of each of the slide bushes. However, such a coating film can be formed to be extended over the proximity range. That is, "the current-flow-restricting coating film" or "restricting coating film," can be formed over the entire area between the exposed end periphery of one of the slide bushes and the exposed end periphery of the other of the slide bushes. However, "the current-flow-restricting coating film" is formed to "include a part of the contact portion of the outer circumferential surface that slidably contacts each of the slide bushes in the rotational axis direction."

According to the vehicle door hinge, an additional ED coating (electrodeposition coating) may be applied as a rust prevention measure to the vehicle main body to which the vehicle door is connected via the vehicle door hinge, and when the electric current is fed from an electrode connected to the vehicle main body to the vehicle door, the electric current can flow in the order of the female bracket, the rotation shaft member, the slide bushes and the male bracket, or in the reverse order thereof.

In addition, according to the vehicle door hinge, the coating film capable of restricting the electric current from flowing from the rotation shaft member to each of the slide bushes, the current-flow-restricting coating film, is formed in a portion of the outer circumferential surface of the rotation shaft member, which portion includes a part of the contact portion thereof that slidably contacts each of the slide bushes in the rotational axis direction and at least a proximity range thereof that is positioned in proximity to the exposed end periphery of each of the slide bushes. Therefore, in a part of the contact portion of the outer circumferential surface of the rotation shaft member that slidably contacts each of the slide bushes in the rotational axis direction and at least the proximity range thereof that is positioned in proximity to the exposed end periphery of each of the slide bushes, the electric current can be prevented from flowing from the rotation shaft member to each of the slide bushes by the current flow restricting coating film.

Accordingly, when the ED coating is applied as a rust-prevention measure and is applied to the vehicle main body to which the vehicle door is connected, the ED coating film cannot be formed in a part of the contact portion of the outer circumferential surface of the rotation shaft member that slidably contacts each of the slide bushes in the rotational axis direction and at least the proximity range thereof that is positioned in proximity to the exposed end periphery of each of the slide bushes. That is, ED coating film that can possibly be cracked and peeled off does not exist in a boundary portion between the rotation shaft member and each of the slide bushes. Therefore, even when each of the slide bushes is rotated relative to the rotation shaft member, so-called "coating irregularity" cannot be generated in a subsequent coating process.

A second aspect of the present invention provides the vehicle door hinge, wherein the current-flow-restricting coating film is an ED coating film that is formed before an electrodeposition coating is applied to the entire vehicle main body including the vehicle door in a condition in which the vehicle door is connected to the vehicle main body via the vehicle door hinge, and wherein the current-flow-restricting coating film has a film thickness greater than a film thickness of an ED coating film formed in the electrodeposition coating that is applied to the entire vehicle main including the vehicle door.

At the vehicle door hinge, the current-flow-restricting coating film has a film thickness greater than a film thickness of the ED coating film formed as a result of the ED coating process performed as a rust prevention measure. Therefore, in the proximity range described above, the electric current can be prevented from flowing therethrough by the current-flow-restricting coating film until the ED coating film formed by the ED coating can have a desired film thickness.

As a result, when the ED coating is applied to the entire vehicle main body including the vehicle door, the film thickness of the ED coating film formed on the entire vehicle main body can be set to an appropriate film thickness while the ED coating film that can possibly be cracked and peeled off can be prevented from being formed in the boundary portion between the rotation shaft member and each of the slide bushes, thereby avoiding formation of the so-called "coating irregularity" described above.

Further, the film thickness of the current-flow-restricting coating film is determined as a film thickness greater than a film thickness that can be calculated based on the film thickness of the ED coating film formed in the electrodeposition coating applied to the entire vehicle main in consideration of a variation in a production process.

According to the vehicle door hinge of the first aspect of the invention, when the additional coating applied as a rust prevention measure to the whole vehicle main body is performed in the condition in which the vehicle door is connected to the vehicle main body, the vehicle door hinge can maintain electrical conductivity, so as to suitably flow the electric current from the vehicle main body to the vehicle door via the vehicle door hinge. As a result, the ED coating film can be uniformly formed. In addition, according to the vehicle door hinge of the first invention, the ED coating film that can possibly be cracked and peeled off cannot be formed in a boundary portion between the rotation shaft member and each of the slide bushes. Therefore, when each of the slide bushes is rotated relative to the rotation shaft member, the so-called "coating irregularity" cannot be generated in a subsequent coating process. As a result, vehicle quality can be improved.

According to the vehicle door hinge of the second aspect of the invention, the film thickness of the ED coating film formed on the entire vehicle main body can be set to an appropriate film thickness. At the same time, the ED coating film that can possibly be cracked and peeled off can be prevented from being formed in the boundary portion between the rotation shaft member and each of the slide bushes. Therefore, a cause of the so-called "coating irregularity" can be removed.

DETAILED DESCRIPTION OF THE INVENTION

In the following, the best mode for carrying out the present invention will be described with reference to the drawings.

Figure 1:
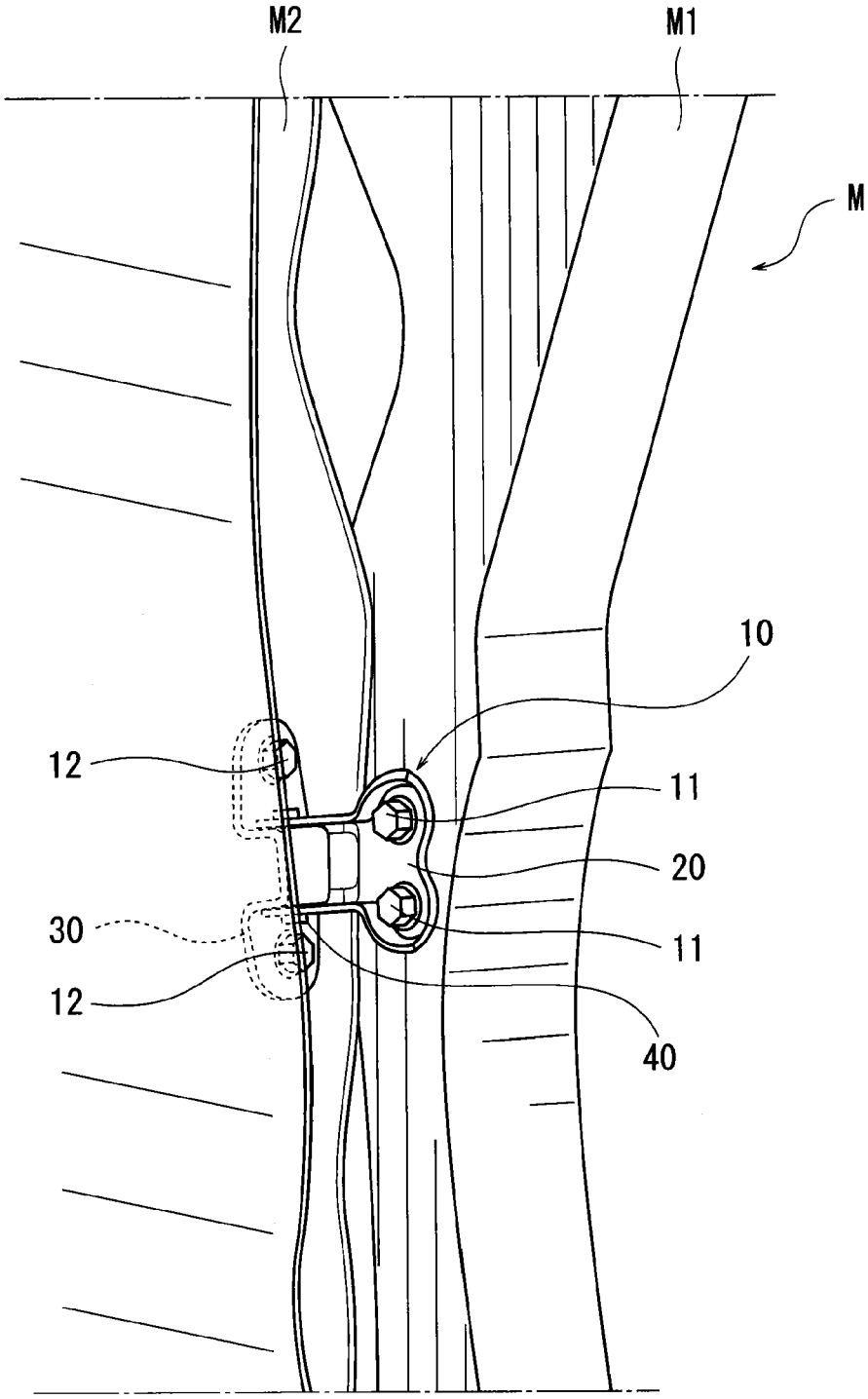
FIG. 1 is a perspective view of an example in which a vehicle door hinge is attached to a vehicle.

FIG. 1 is a perspective view of an example in which a vehicle door hinge 10 is attached to a vehicle M. More particularly, FIG. 1 is a perspective view of a portion between a vehicle main body M1 and a vehicle door M2 in which the vehicle door hinge 10 is provided, which view is viewed from before.

As shown in FIG. 1, the vehicle door hinge 10 is provided between the vehicle main body M1 and the vehicle door M2 and connects the same to each other in order to connect the vehicle door M2 to the vehicle main body M2 so as to be openable and closable. Further, in FIG. 1, an example in which a single vehicle door hinge 10 is provided between the vehicle main body M1 and the vehicle door M2 is shown. However, in general, two vehicle door hinges are respectively provided in upper and lower positions.

Figure 2:
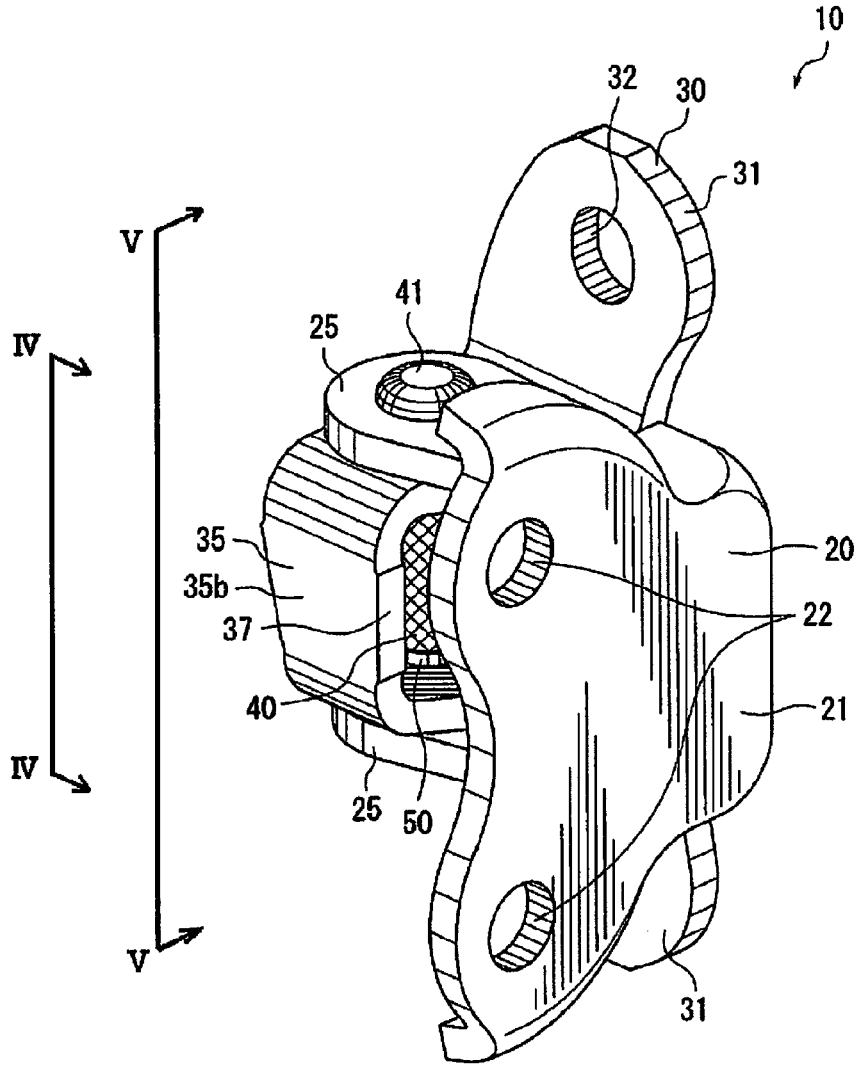
FIG. 2 is an enlarged perspective view of the vehicle door hinge.
Figure 3:
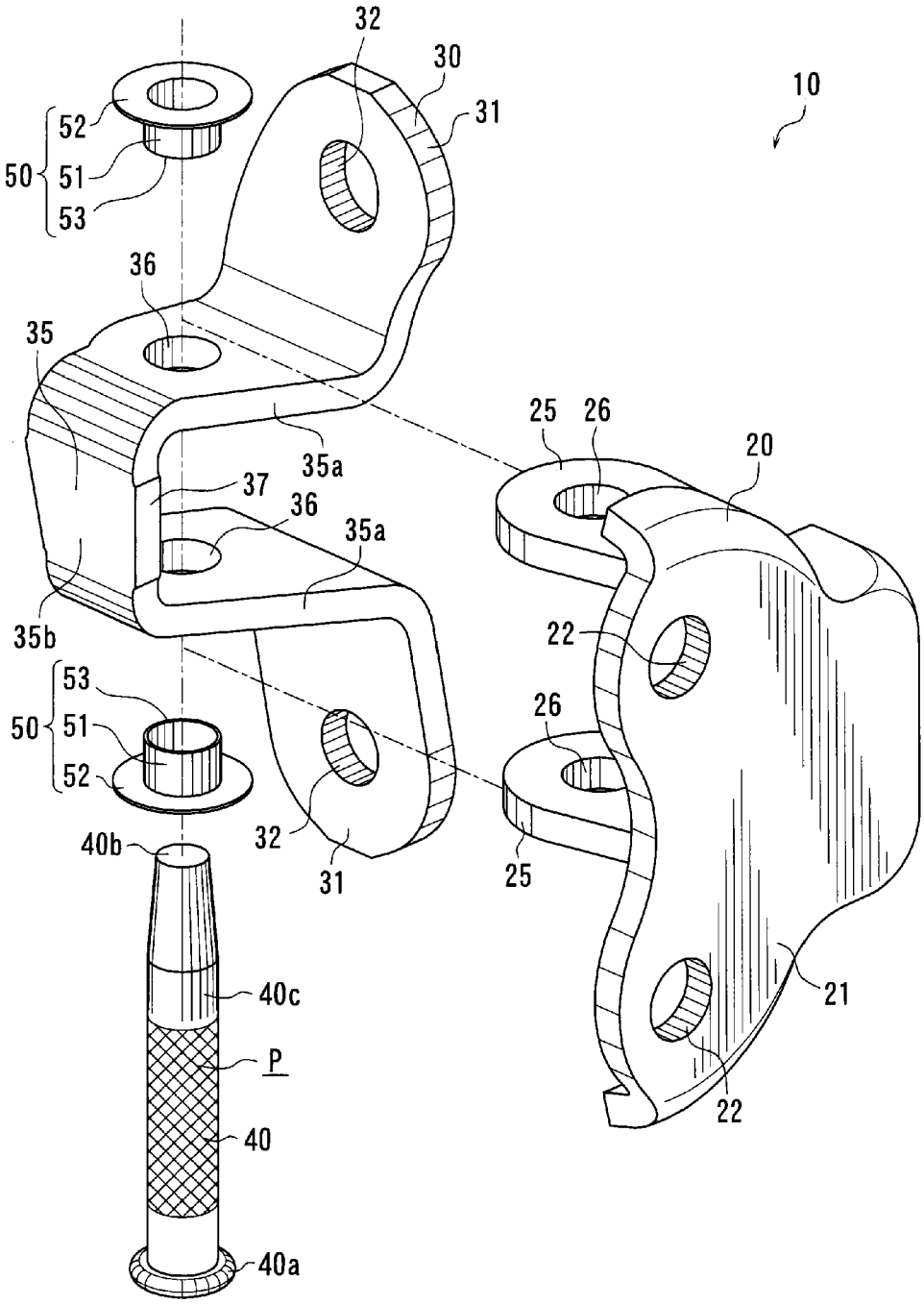
FIG. 3 is an exploded perspective view of the vehicle door hinge shown in FIG. 2.
Figure 4:
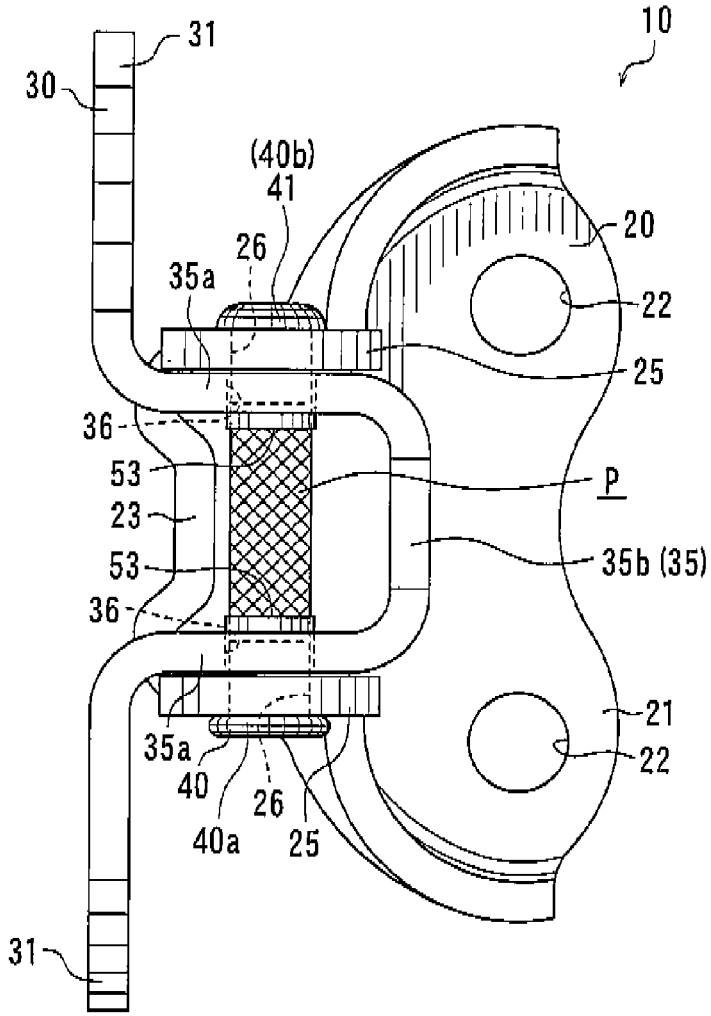
FIG. 4 is a side view of the vehicle door hinge shown in FIG. 2, which view is viewed in a direction of arrow line IV-IV.
Figure 5:
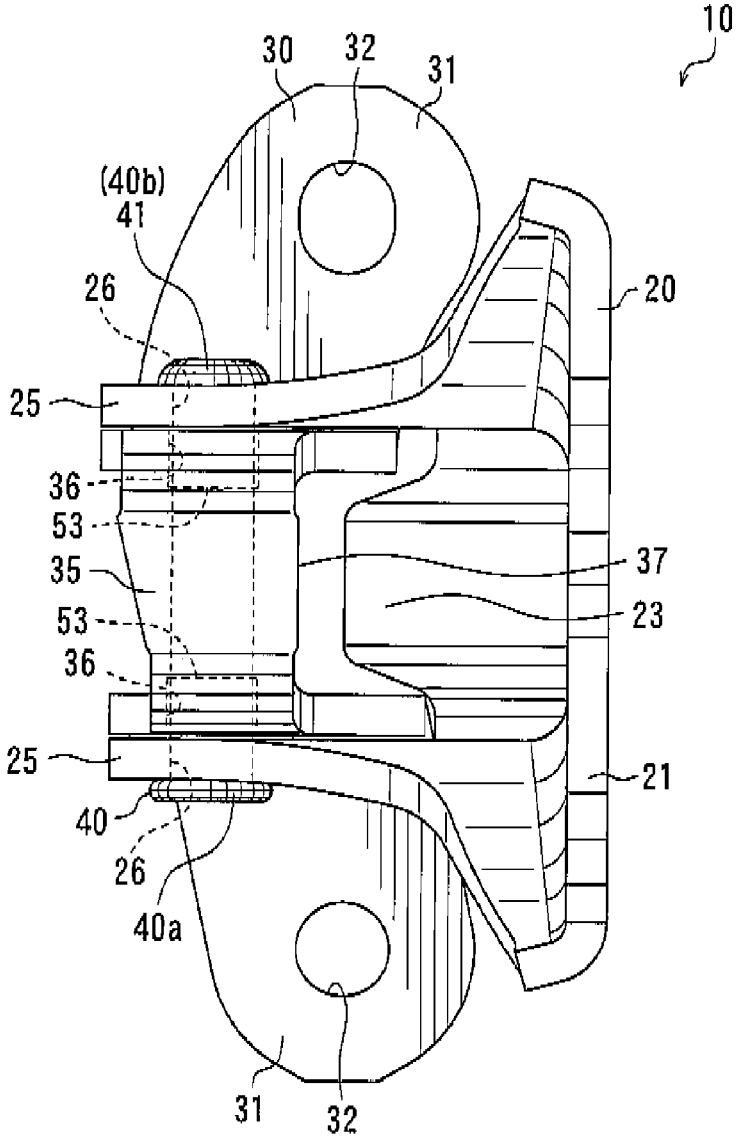
FIG. 5 is a side view of the vehicle door hinge shown in FIG. 2, which view is viewed in a direction of arrow line V-V.
Figure 6:
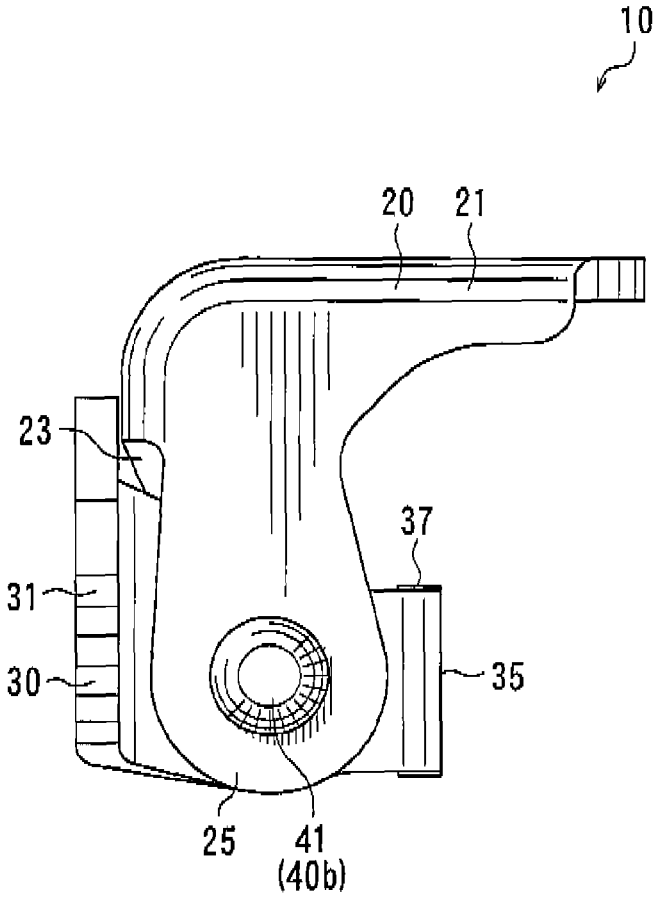
FIG. 6 is a side view of the vehicle door hinge shown in FIG. 2, which view is viewed from above.

FIG. 2 is an enlarged perspective view of the vehicle door hinge. FIG. 3 is an exploded perspective view of the vehicle door hinge shown in FIG. 2. FIG. 4 is a side view of the vehicle door hinge shown in FIG. 2, which view is viewed in a direction of arrow line IV-IV. FIG. 5 is a side view of the vehicle door hinge shown in FIG. 2, which view is viewed in a direction of arrow line V-V. FIG. 6 is a side view of the vehicle door hinge shown in FIG. 2, which view is viewed from above.

As shown in FIGS. 2 and 3, in general, the vehicle door hinge 10 is composed of a female bracket 20, a male bracket 30, a rotation shaft member 40 and slide bushes 50. Further, the female bracket 20, the male bracket 30, the rotation shaft member 40 and the slide bushes 50 are made of electroconductive materials, so as to be electrically connected to each other when these members contact each other. In the following, each of the members constituting the vehicle door hinge 10 will be described.

As shown in FIG. 1, the female bracket 20 is securely attached to the vehicle main body M1 and is formed by appropriately processing a steel material having a thickness of 5 mm. As shown in FIGS. 2 and 3, the female bracket 20 includes a plate-shaped attachment portion 21 that is capable of being secured to the vehicle main body M1, and female bearing portions 25 that extend from the plate-shaped attachment portion 21 in a direction to intersect the plate-shaped attachment portion 21.

As also shown in FIG. 1, the plate-shaped attachment portion 21 is a portion that is attached to a pillar portion constituting the vehicle main body M1 by bolts 11 and nuts (not shown). In particular, as shown in FIG. 3, the plate-shaped attachment portion 21 has two insertion holes 22 into which the bolts 11 are inserted, which insertion holes are formed therein in juxtaposition.

Further, the female bearing portions 25 are portions that are rotatably connected to a male bearing portion 35 of the male bracket 30 via the rotation shaft member 40 while the male bearing portion 35 is inserted between the female bearing portions 25, which will be hereinafter described in detail. In particular, as shown in FIGS. 2 and 3, the female bearing portions 25 are formed as two members that extend in an arm-like fashion in the direction to intersect the plate-shaped attachment portion 21. Thus, the female bearing portions 25 are positioned opposite to each other such that the male bearing portion 35 can be inserted therebetween, and respectively have bearing holes 26 into which the rotation shaft member 40 is inserted.

Further, although not shown in FIGS. 2 and 3, as shown in FIGS. 4 and 5, the female bracket 20 has a rotationally restricting projection-plate portion 23. The rotationally restricting projection-plate portion 23 is a portion that can contact a rotationally restricting contact portion 37 of the male bracket 30 when the male bracket 30 is rotated relative to the female bracket 20, so as to restrict a relative rotation of the male bracket 30 with respect to the female bracket 20 within a predetermined range. In particular, the rotationally restricting projection-plate portion 23 is formed so as to slightly protrude from the plate-shaped attachment portion 21 toward the female bearing portions 25 and to be positioned between the female bearing portions 25. The predetermined range of the relative rotation can be set in accordance with an opening range of the vehicle door M2.

As shown in FIG. 1, the male bracket 30 is securely attached to the vehicle door M2 and is formed by appropriately processing a steel material having a thickness of 5 mm. As shown in FIGS. 2 and 3, the male bracket 30 includes plate-shaped attachment portions 31 that can be secured the vehicle door M2, and the male bearing portion 35 that is bent formed so as to protrude from the plate-shaped attachment portions 31.

As also shown in FIG. 1, the plate-shaped attachment portions 31 are portions that are attached to a front side-surface portion constituting the vehicle door M2 by bolts 12 and nuts (not shown). In particular, as shown in FIG. 3, the plate-shaped attachment portions 31 respectively have insertion holes 32 into which the bolts 12 are inserted.

Further, the male bearing portion 35 is a portion that is rotatably connected to the female bearing portions 25 of the female bracket 20 via the rotation shaft member 40 while being inserted between the female bearing portions 25. In particular, as shown in FIGS. 2 and 3, the male bearing portion 35 is formed so as to protrude from the plate-shaped attachment portions 31 and has a substantially rectangular shape. More particularly, the male bearing portion 35 has bearing portion main bodies 35*a* that are supported by the rotation shaft member 40 and are positioned adjacent to the female bearing portions 25 of the female bracket 20, and a connecting portion 35*b* that connects the bearing portion main bodies 35*a* to each other. The bearing portion main bodies 35*a* of the male bearing portion 35 respectively have bearing holes 36 into which the rotation shaft member 40 is inserted.

Further, the male bearing portion 35 that is protruded to have the substantially rectangular shape has a rotationally restricting contact portion 37 formed in an end edge thereof, which contact portion is configured to contact the rotation restricting projection-plate 23 provided to the female bracket 20. As described above, the rotationally restricting contact portion 37 is a portion that can contact the rotation restricting projection-plate portion 23 when the male bracket 30 is rotated relative to the female bracket 20. In particular, the rotationally restricting contact portion 37 is formed so as to slightly protrude from the end edge of the male bearing portion 35 toward the plate-shaped attachment portion 21 of the female bracket 20.

As shown in FIG. 2, the rotation shaft member 40 is a member that functions to support the male bracket 30 to be rotatable relative to the female bracket 20, and is secured to the female bracket 20 by swaging.

In particular, as shown in FIG. 3, the rotation shaft member 40 is shaped to have a substantially columnar shape, so as to function as a rotation shaft. Further, the rotation shaft member 40 has a retaining end portion 40*a* formed in one end portion (a lower end portion in the drawings) and having a flanged retainable shape, so as to be secured to the female bracket 20 when swaged. Conversely, the rotation shaft member 40 has a swaging end portion 40*b* formed in the other end portion (an upper end portion in the drawings) and having a tapered shape that is capable of being swaged.

That is, in a condition in which the male bearing portion 35 of the male bracket 30 is inserted between the female bearing portions 25 of the female bracket 20, the rotation shaft member 40 is passed through the bearing holes 26 of the female bearing portions 25 and the bearing holes 36 of the male bearing portion 35 while it is passed through the slide bushes 50 which will be hereinafter described. Thereafter, the swaging end portion 40*b* of the rotation shaft member 40 is swaged. As a result, the rotation shaft member 40 is secured to the female bracket 20 while it is integrated with the female bearing portions 25 of the female bracket 20 that are positioned outside. Further, upon swaging, the swaging end portion 40*b* can be deformed from a shape shown in FIG. 3 into a struck and swaged shape (reference numeral 41) shown in FIG. 2. Further, the slide bushes 50 are positioned between the rotation shaft member 40 and the male bracket 30, so as to rotate integrally with the male bracket 30, and the male bracket 30 can be relatively rotated with respect to the female bracket 20, which will be hereinafter described in detail.

The slide bushes 50 are disposed between the rotation shaft member 40 and the male bracket 30 in order to smoothly rotate the male bracket 30 with respect to the rotation shaft member 40. The slide bushes 50 are positioned to rotate relative to the rotation shaft member 40 while rotating integrally with the male bracket 30. As shown in FIG. 3, each of the slide bushes 50 has a cylindrical member 51 through which the rotation shaft member 40 is inserted, and an outer flange portions 52 that is projected outwardly along one end periphery of the cylindrical member 51. Each of the slide bushes 50 is formed by being coated with carbonaceous resin, so as to smoothly slide while it is electrically connected to the rotation shaft member 40. In particular, each of the slide bushes 50 is composed of a core member that is formed by a metal mesh of fine metal wires, and is coated with the carbonaceous resin having superior electrical conductivity and excellent slidability.

The slide bushes 50 thus formed are respectively provided between each of the bearing and 36 of the male bearing portion 35. In particular, the slide bushes 50 are positioned such that the cylindrical members 51 thereof are respectively fitted into the bearing holes 36 of the male bearing portion 35 while the outer flange portions 52 thereof are respectively positioned in portions in which the female bearing portions 25 and the bearing portion main bodies 35*a* of the male bearing portion 35 are positioned adjacent to each other. At this time, the other end periphery of each of the slide bushes 50 positioned opposite to one end periphery thereof in which the outer flange 52 is formed may constitute an exposed end periphery 53 that is faced toward a center of the rotation shaft member 40 and is exposed to an exterior. In other words, as shown in FIG. 4, in the slide bushes 50 in an assembled condition, the exposed end peripheries 53 positioned opposite to each other are exposed to the exterior from the bearing portion main bodies 35*a* by "0.5 to 1.0 mm (reference numeral S2 in FIG. 7)." Thus, because the slide bushes 50 are provided to the rotation shaft member 40, the slide bushes 50 can smoothly rotate with respect to the rotation shaft member 40. As a result, the male bracket 30 can smoothly rotate with respect to the female bracket 20.

In the vehicle door hinge 10 constructed and assembled as described above, the rotation shaft member 40 has a current-flow-restricting coating film P that is formed in a portion of an outer circumferential surface 40*c* of the rotation shaft member 40. Next, the current-flow-restricting coating film P will be described in detail.

Figure 7:
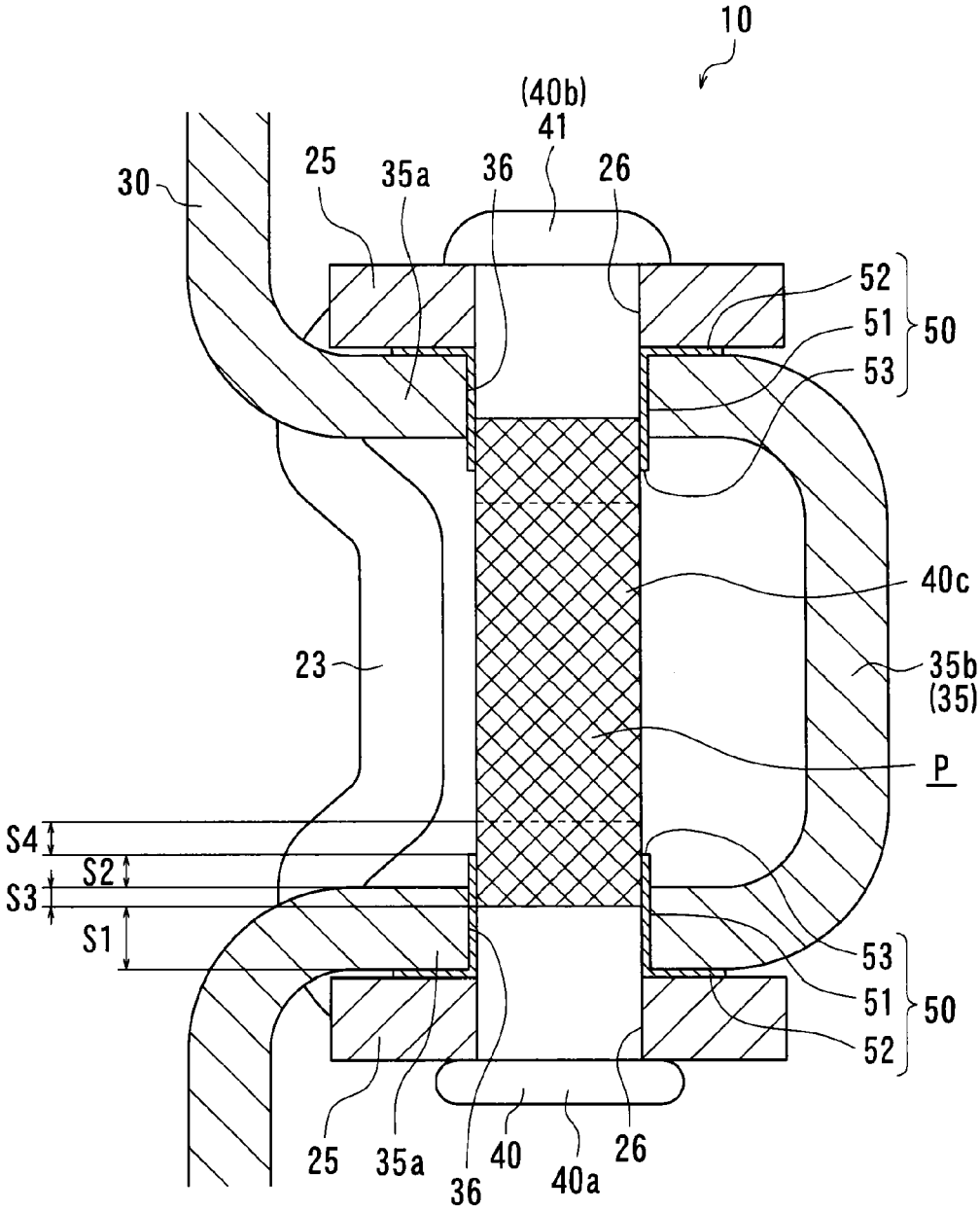
FIG. 7 is an enlarged side view illustrating a rotation portion when a male bracket rotates relative to a female bracket.

FIG. 7 is an enlarged side view illustrating a rotation portion when the male bracket 30 rotates relative to the female bracket 20 of the vehicle door hinge 10. In FIG. 7, in order to clearly show the current-flow-restricting coating film P that is formed in the outer circumferential surface 40*c* of the rotation shaft member 40, the members other than the rotation shaft member 40, i.e., the female bracket 20, the male bracket 30 and the slide bushes 50, are shown in cross-sectional views, and the rotation shaft member 40 is shown in a side view.

That is, in a process of ED coating of the entire vehicle main body M1 described above, an electric current flows from an electrode connected to the vehicle main body M1 to the vehicle door M2 via the vehicle door hinge 10. The electric current flowing through the vehicle door hinge 10 flows in the order of the female bracket 20, the rotation shaft member 40, the slide bushes 50 and the male bracket 30.

The current-flow-restricting coating film P functions to restrict the electric current from flowing from the rotation shaft member 40 to the slide bushes 50. The current-flow-restricting coating film P is an ED coating film that is formed before the ED coating (electrodeposition coating) is applied to the entire vehicle main body M1 including the vehicle door M2 in a condition in which the vehicle door M2 is connected to the vehicle main body M1 via the vehicle door hinge 10. The previously-formed ED coating film has a film thickness (20 μm) greater than a film thickness (15 μm) of an additional ED coating film formed during the ED coating process and that is applied to the entire vehicle main M1 including the vehicle door M2. Thus, the film thickness of the current-flow-restricting coating film P is set to "20 μm." This film thickness is determined as a film thickness greater than a film thickness "12 to 18 μm" that can be calculated based on the film thickness "15 μm" of the ED coating film formed in the ED coating process applied to the entire vehicle main M1 in consideration of a variation "±3 μm" in the production process. Naturally, because the current-flow-restricting coating film P has a function that restricts the electric current from flowing, carbon or other such materials having conductive property cannot be included in materials of the current-flow-restricting coating film P.

Further, as shown in FIG. 7, the current-flow-restricting coating film P is formed in a portion of the outer circumferential surface 40*c* of the rotation shaft member 40, which portion includes only a part of each of contact portions thereof that slidably contact the slide bushes 50 in a rotational axis direction and at least proximity ranges thereof that are positioned in proximity to the exposed end peripheries 53 of the slide bushes 50. That is, in the contact portions of the outer circumferential surface 40*c* of the rotation shaft member 40 slidably contacting the slide bushes 50, ranges other than the ranges that are provided with the coating film P can be electrically coupled to the slide bushes 50. Each of these ranges is set as an electrically conductive range of the rotation shaft member 40.

Figure 8:
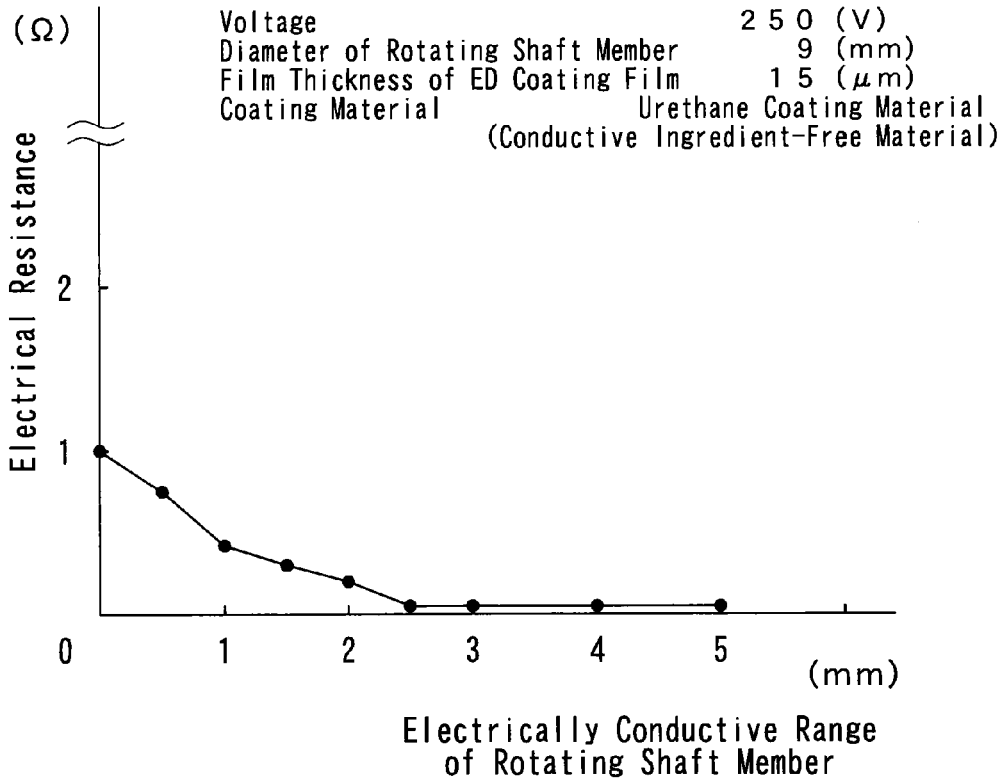
FIG. 8 is a graph illustrating a relation between an electrically conductive range and electrical resistance of a rotation shaft member slidably contacting a slide bush.

FIG. 8 is a graph illustrating a relation between the electrically conductive range and electrical resistance of the rotation shaft member 40 slidably contacting the slide bushes 50.

As will be recognized from "the graph illustrating the relation between the electrically conductive range and the electrical resistance" shown in FIG. 8, a value of the electrical resistance can be increased when the electrically conductive range of the rotation shaft member 40 is not greater than "2 mm." Accordingly, when the electrically conductive range of the rotation shaft member 40 is maintained in a range not less than "2.5 mm," the value of the electrical resistance can be minimized. That is, it is desirable that the electrically conductive range of the rotation shaft member 40 is set to a value "not less than 2 mm" at which the electrical resistance is close to a minimum value.

Thus, as shown in FIG. 7, each of electricity supply portions (reference numeral S1) of the rotation shaft member 40 of the vehicle door hinge 10 is set to "3.5 mm." Conversely, each of portions of the rotation shaft member 40 in which the current-flow-restricting coating film P overlaps the slide bushes 50 (reference numerals S2 and S3) is set to "2 mm." As previously described, the exposed end peripheries 53 of the slide bushes 50 are exposed to the exterior from the bearing portion main bodies 35*a* by "0.5 mm" (reference numeral S2). Further, each of portions of the slide bushes 50 that overlap the current-flow-restricting coating film P and the bearing portion main bodies 35*a* (reference numeral S3) is set to "1.5 mm." Further, the current-flow-restricting coating film P is formed over the entire area between the exposed end periphery 53 of one of the slide bushes 50 and the exposed end periphery 53 of the other of the slide bushes 50 positioned opposite thereto. That is, the current-flow-restricting coating film P is formed to include the proximity ranges (reference numeral S4) that are positioned in proximity to the exposed end peripheries 53 of the slide bushes 50.

The vehicle door hinge 10 of the present embodiment described above may have following effects.

That is, according to the vehicle door hinge 10, in the ED coating applied as a rust prevention measure to the vehicle main body M1 to which the vehicle door M2 is connected via the vehicle door hinge 10, when the electric current is fed from the electrode connected to the vehicle main body M1 to the vehicle door M2, the electric current can flow in the order of the female bracket 20, the rotation shaft member 40, the slide bushes 50 and the male bracket 30. Further, as each of electricity supply portions (reference numeral S1) of the rotation shaft member 40 of the vehicle door hinge 10 is set to "3.5 mm," the electric current from the female bracket 20 can be supplied to the slide bushes 50 via the rotation shaft member 40 without any resistance, and then be suitably supplied to the male bracket 30 via the slide bushes 50. As a result, the electric current can be appropriately supplied from the electrode connected to the vehicle main body M1 to the vehicle door M2. Therefore, when the electrodeposition coating serving as the rust prevention measure is applied in the condition in which the vehicle door M2 is connected to the vehicle main body M1, an ED coating film can be uniformly formed.

In addition, according to the vehicle door hinge 10, the coating film P capable of restricting the electric current from flowing from the rotation shaft member 40 to the slide bushes 50 is formed in a portion of the outer circumferential surface 40*c* of the rotation shaft member 40, which portion includes a part (reference numerals S2 and S3) of each of the contact portions thereof that slidably contact the slide bushes 50 in the rotational axis direction and at least the proximity ranges (reference numeral S4) thereof that are positioned in proximity to the exposed end peripheries 53 of the slide bushes 50. Therefore, in a part (reference numerals S2 and S3) of each of the contact portions of the outer circumferential surface 40*c* of the rotation shaft member 40 that slidably contact the slide bushes 50 in the rotational axis direction and at least the proximity ranges (reference numeral S4) thereof that are positioned in proximity to the exposed end peripheries 53 of the slide bushes 50, the electric current can be restricted from flowing from the rotation shaft member 40 to the slide bushes 50 by the current-flow-restricting coating film P.

Accordingly, when ED coating for rust prevention is performed in the condition in which the vehicle door M2 is connected to the vehicle main body M1, an ED coating film cannot be formed in a part (reference numerals S2 and S3) of each of the contact portions of the outer circumferential surface 40*c* of the rotation shaft member 40 that slidably contact the slide bushes 50 in the rotational axis direction and at least the proximity ranges (reference numeral S4) thereof that are positioned in proximity to the exposed end peripheries 53 of the slide bushes 50. That is, the ED coating film that can possibly be cracked and peeled off does not exist in boundary portions between the rotation shaft member 40 and the slide bushes 50. Therefore, even when the slide bushes 50 are rotated relative to the rotation shaft member 40, so-called "coating irregularity" cannot be generated in a subsequent coating process.

Thus, according to the vehicle door hinge 10, when the ED coating as the rust prevention measure of the whole vehicle main body M1 is performed in the condition in which the vehicle door M2 is connected to the vehicle main body M1, an ED coating film can be uniformly formed. However, in the boundary portions between the rotation shaft member 40 and the slide bushes 50, an ED coating film that can possibly be cracked and peeled off cannot be formed. Therefore, even when the slide bush 50 is rotated relative to the rotation shaft member 40, the so-called "coating irregularity" cannot be generated in the subsequent coating process. As a result, the vehicle M can be increased in quality.

According to the vehicle door hinge 10, the current-flow-restricting coating film has an film thickness greater than the film thickness of the ED coating film formed during the additional ED coating process for rust prevention. Therefore, in the proximity ranges described above, the electric current can be restricted by the current-flow-restricting coating film until the ED coating film formed by the additional ED coating process can have a desired film thickness.

As a result, when an ED coating is applied to the entire vehicle main body M1 including the vehicle door M2, the film thickness of the ED coating film formed on the entire vehicle main body M1 can be set to an appropriate film thickness while the ED coating film that could possibly be cracked and peeled off can be prevented from being formed in the boundary portions between the rotation shaft member 40 and the slide bushes 50, thereby preventing the so-called "coating irregularity" described above.

Further, the vehicle door hinge according to the present invention is not limited to the embodiment described above and can be modified without departing from the scope of the present invention.

That is, in the vehicle door hinge 10 of the embodiment described above, a part (reference numerals S2 and S3) of each of the contact portions of the outer circumferential surface 40*c* of the rotation shaft member 40 that slidably contact the slide bushes 50 in the rotational axis direction is set to "0.5 mm+1.5 mm." This is determined in view of the fact that the male bracket 30 has a thickness of 5 mm and that each of the electricity supply portions (reference numeral S1) of the rotation shaft member 40 of the vehicle door hinge 10 is set to "3.5 mm." However, a part (reference numerals S2 and S3) of each of the contact portions of the outer circumferential surface 40*c* of the rotation shaft member 40 that slidably contact the slide bushes 50 in the rotational axis direction is not limited to a range of the present embodiment. That is, this can be changed in view of each of the electricity supply portions of the rotation shaft member that is determined such that the electrically conductive range of the rotation shaft member can be "not less than 2 mm," as well as in view of the thickness of the male bracket.

Further, in the vehicle door hinge 10 according to the embodiment described above, the current-flow-restricting coating film P is formed over the entire area between the exposed end periphery 53 of one of the slide bushes 50 and the exposed end periphery 53 of the other of the slide bushes 50 positioned opposite thereto. However, the current-flow-restricting coating film of the present invention can be formed in, for example, only proximity ranges each of which extends over approximately "0.5 to 2.0 mm" from the exposed end periphery of each of the slide bushes in the rotational axis direction. The current-flow-restricting coating film thus formed may have the same effects. Further, as described above, in a case in which the current-flow-restricting coating film P is formed over the entire area between the exposed end periphery 53 of one of the slide bushes 50 and the exposed end periphery 53 of the other of the slide bushes 50 positioned opposite thereto, it is advantageous in that the coating film P can be formed continuously.

Further, in the vehicle door hinge 10 of the embodiment described above, the female bracket 20 is secured to the vehicle main body M1, and the male bracket 30 is secured to the vehicle door M2. However, in the vehicle door hinge of the present invention, the female bracket can be secured to the vehicle door, and the male bracket can be secured to the vehicle main body. However, in this case, when the electric current flows from the electrode connected to the vehicle main body to the vehicle door, the electric current flows in the order of the male bracket, the slide bushes, the rotation shaft member 40 and the female bracket 20.

The invention claimed is:

1. A vehicle door hinge that is positioned between a vehicle main body and a vehicle door and connects the vehicle door to the vehicle main body so that the vehicle door is openable and closable, the hinge comprising:

a female bracket that is securely attached to one of the vehicle main body and the vehicle door, a male bracket that is securely attached to the other of the vehicle main body and the vehicle door, a rotation shaft member that is secured to the female bracket and supports the male bracket to be rotatable relative to the female bracket, wherein slide bushes are disposed between the rotation shaft member and the male bracket in order to smoothly rotate the male bracket with respect to the rotation shaft member, the slide bushes being capable of rotating integrally with the male bracket, wherein the female bracket, the male bracket, the rotation shaft member and the slide bushes are made of an electroconductive material, so as to be electrically connected to each other when these members contact each other, and wherein a current-flow-restricting coating film capable of restricting an electric current from flowing from the rotation shaft member to each of the slide bushes is formed on a portion of an outer circumferential surface of the rotation shaft member, the portion being less than an entirety of the outer circumferential surface of the rotation shaft member, the current-flow-restricting coating film extending so as to overlap each of the slide bushes whilst still allowing electrical contact to be maintained between the slide bushes and the rotation shaft.

2. The vehicle door hinge according to claim 1, wherein the current-flow-restricting coating film is an electrodeposition coating film that is formed before an additional electrodeposition coating is applied to the entire vehicle main body including the vehicle door and the vehicle door hinge in a condition in which the vehicle door is connected to the vehicle main body via the vehicle door hinge, and wherein the current-flow-restricting coating film has a film thickness greater than a film thickness of the additional electrodeposition coating film applied to the entire vehicle main body including the vehicle door and the vehicle door hinge.

* * * * *